US006453581B1

(12) United States Patent
Kiniry et al.

(10) Patent No.: US 6,453,581 B1
(45) Date of Patent: Sep. 24, 2002

(54) SNOWSHOE CRAMPON SYSTEM

(75) Inventors: Daniel P. Kiniry; Francis E. Mahoney, both of Barre Town, VT (US)

(73) Assignee: Tubbs Snowshoe Company, LLC, Stowe, VT (US)

( * ) Notice: Subject to any disclaimer, the term of this patent is extended or adjusted under 35 U.S.C. 154(b) by 0 days.

(21) Appl. No.: 09/900,603

(22) Filed: Jul. 9, 2001

(51) Int. Cl.[7] ..... A43B 5/04; A43B 5/16; A43C 15/00

(52) U.S. Cl. ..... 36/122; 36/124; 36/62; 36/66

(58) Field of Search ..... D21/760, 768, D21/769, 771, 772, 773, 774; 36/122, 123, 124, 125, 59 R, 62, 64, 65, 66

(56) References Cited

U.S. PATENT DOCUMENTS

| | | | | | |
|---|---|---|---|---|---|
| 3,685,173 | A | * | 8/1972 | Piazza | 36/64 |
| 4,351,121 | A | * | 9/1982 | Wallace | 36/125 |
| 4,620,375 | A | * | 11/1986 | Wallace | 36/125 |
| 5,493,794 | A | * | 2/1996 | McKenzie et al. | 36/122 |
| 5,687,491 | A | * | 11/1997 | Klebahn | 36/122 |
| 5,901,471 | A | * | 5/1999 | Warner | 36/124 |
| D429,513 | S | * | 8/2000 | Warner | D21/771 |
| 6,256,908 | B1 | * | 7/2001 | Warner | 36/122 |

FOREIGN PATENT DOCUMENTS

| | | | | |
|---|---|---|---|---|
| CH | 656052 | * | 6/1986 | 36/122 |

* cited by examiner

*Primary Examiner*—Anthony D. Stashick
(74) *Attorney, Agent, or Firm*—Ross, Ross & Flavin

(57) ABSTRACT

A snowshoe crampon system has toe and heel crampons which are fabricated from strong, hard abrasion resistant material such as stainless steel, titanium, or tool steel, the toe crampon having a depending formed skirt and a trio of tooth pairs depending angularly therefrom, namely: a pair of forward climbing teeth, a pair of lateral traction teeth and a pair of rear braking teeth, each tooth of each pair having an outwardly curved, convex, crowned outer face which Is grooved to form a gusset, each tooth pair being disposed at such an angle as to contribute to the traction provided by the other two pair; the heel crampon having two pair of teeth, namely: a pair of lateral traction teeth and a pair of rear braking teeth, the pair of lateral traction teeth being disposed on a plane parallel to the direction of snowshoe travel and the pair of rear braking teeth being disposed at an angle relative to the direction of snowshoe travel.

7 Claims, 5 Drawing Sheets

SNOWSHOE CRAMPON SYSTEM

BACKGROUND OF THE INVENTION

1. Field of the Invention

The invention relates to snowshoes and more particularly to crampons or cleats which add traction to the snowshoe.

2. Description of the Related Art

Snowshoe construction has evolved from wooden frames and animal skin lacing, to synthetic frames and decks, fabricated from metal or plastic or from a composite of these materials.

Early usage was primarily utilitarian.

Currently, snowshoes are used for recreational activities, such as walking, hiking, mountaineering, racing, and physical fitness.

The change to synthetic materials reduced the "natural" traction of laced rawhide; while the new recreational applications created a need for greater traction.

Manufacturers reacted to the traction deficiency by adding crampons or cleats to the snowshoe.

Initially, the crampons were added under the ball of the foot and called "toe crampons".

Soon thereafter, crampons were added under the heel of the foot and called "heel crampons".

These toe and heel crampons increased traction and expanded the terrain passable with snowshoes.

However, there are a number of shortcomings with existing crampons. All known crampons exhibit one or more of the following flaws: 1) a lack of lateral teeth; 2) a lack of braking teeth; 3) climbing teeth which have minimum penetration on steep climbs; 4) lateral teeth which exit snow as the foot pivots; 5) heel teeth which provide little braking; 6) teeth which are thick and blunt and provide little penetration on a packed surface; 7) teeth which are co-planer, whereby they have the shortcoming of providing little traction in a direction parallel to the plane of travel, wherein walking action is impeded on a hard packed surface; and 8) the total lack of lateral teeth or, lateral teeth which, if present, are too short, thereby also impeding walking on a hard packed surface.

BRIEF SUMMARY OF THE INVENTION

The invention provides crampons or cleats fabricated from a strong, hard, abrasion resistant material such as stainless steel, titanium, or tool steel, or the like, which enable snowshoers to further access hostile terrain conditions.

The toe crampons hereof have climbing teeth which are designed to extend beyond the toe of the boot of a user to handle steep Inclines and have lateral teeth which dig deeper Into the snow as the boot pivots forwardly. This Is extremely beneficial in side hill traverse.

The toe crampons also have braking teeth which enable a confident grip on descents, and assist on uphill climbs. Each of the teeth are positioned and angled to assist traction In all snowshoe terrain conditions.

All of the above-noted features offer a high traction solution at relatively light weight.

In addition, each toe crampon tooth is crowned or outwardly curved in transverse cross section; when tested, it has been found that such crowning adds 50% more strength to the tooth, without adding weight.

Also, the toe crampon hereof has a formed skirt feature.

The teeth of prior art, competitive crampons, are formed by bending the teeth on a linear axis, to a near vertical position. The axis of the bend is, effectively, the intersection of the two planes.

In applicants' crampon, there is no linear bend axis. The entire circumference of the crampon is formed on a curved profile. Again, this adds tremendous strength and the rigidity needed for ice engagement, with little added weight.

In addition to the formed skirt feature, the toe crampon has three pairs of teeth, each pair identified for its primary function as:

a) climbing teeth;

b) lateral traction teeth; and c) braking teeth.

It is important to note that each pair of teeth is formed on a different angle from the other pairs, which means that each pair contributes to traction In the other two functions.

Further improvements in applicants' toe crampon include:

a) its unique grooved or debossed teeth;

b) such grooving or debossing of the teeth providing gusseting on bends, thereby imparting fore and aft stiffness;

c) its rear teeth;

d) its foot plate having a rear portion formed at a 9° angle;

e) a channel formed in the footplate for the snowshoe pivot axle;

f) lateral teeth located forward of the pivot point which is located at the ball of the foot;

g) longer lateral teeth to allow a rolling action on a packed snow surface; and h) the teeth providing a three axis traction function.

Applicants' heel crampon has the following features not found in the prior art:

1.) single piece fabrication which includes two pair of teeth bent on individual angles;

2.) each pair including lateral traction teeth; and

3.) each pair including braking teeth.

These features are vital for improved side hill traverse activity in crystallized snow conditions.

The toe crampon's teeth alone give added resistance to side slide; however, when used with the heel crampon, a wide traction base is provided to resist turning while the snowshoe remains properly aligned until lifted from the snow.

In applicants' heel crampon, two teeth are placed parallel to the direction of snowshoe travel to prevent lateral slide or yawing of the snowshoe; and two teeth are placed at an angle relative to snowshoe travel to assist In both climbing and braking traction.

The stainless steel, or titanium, or tool steel, or the like, from which the crampons are fabricated, offers excellent strength and abrasion resistance while being thin enough to pierce packed or crystallized snow.

DETAILED DESCRIPTION OF THE INVENTION

The snowshoe crampon system of the invention is generally indicated by 10 and comprises a toe crampon or cleat 12 and a heel crampon or cleat 14 mounted relative to a snowshoe frame generally indicated by 16 of the usual open rectangular shape in top plan which may be fabricated from wood, metal or plastic.

The toe and heel crampons or cleats are preferably fabricated from a strong, hard, abrasion resistant material such as stainless steel, or titanium, or tool steel, or the like, thereby enabling the snowshoer to further access hostile terrain conditions.

Figure 11:
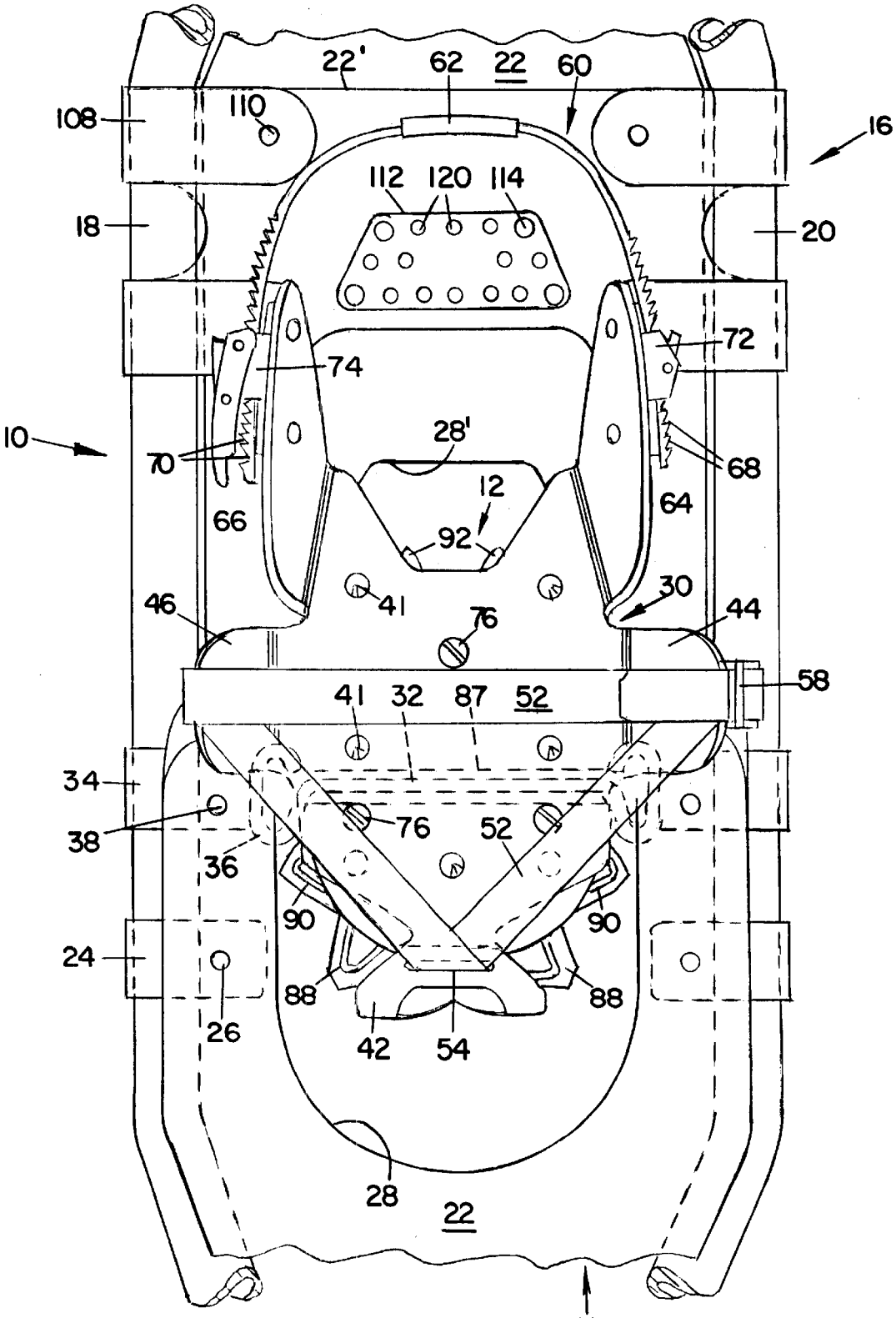
FIG. 11 is a fragmentary, top plan view of a snowshoe incorporating the toe and heel crampons of the invention.
Figure 12:
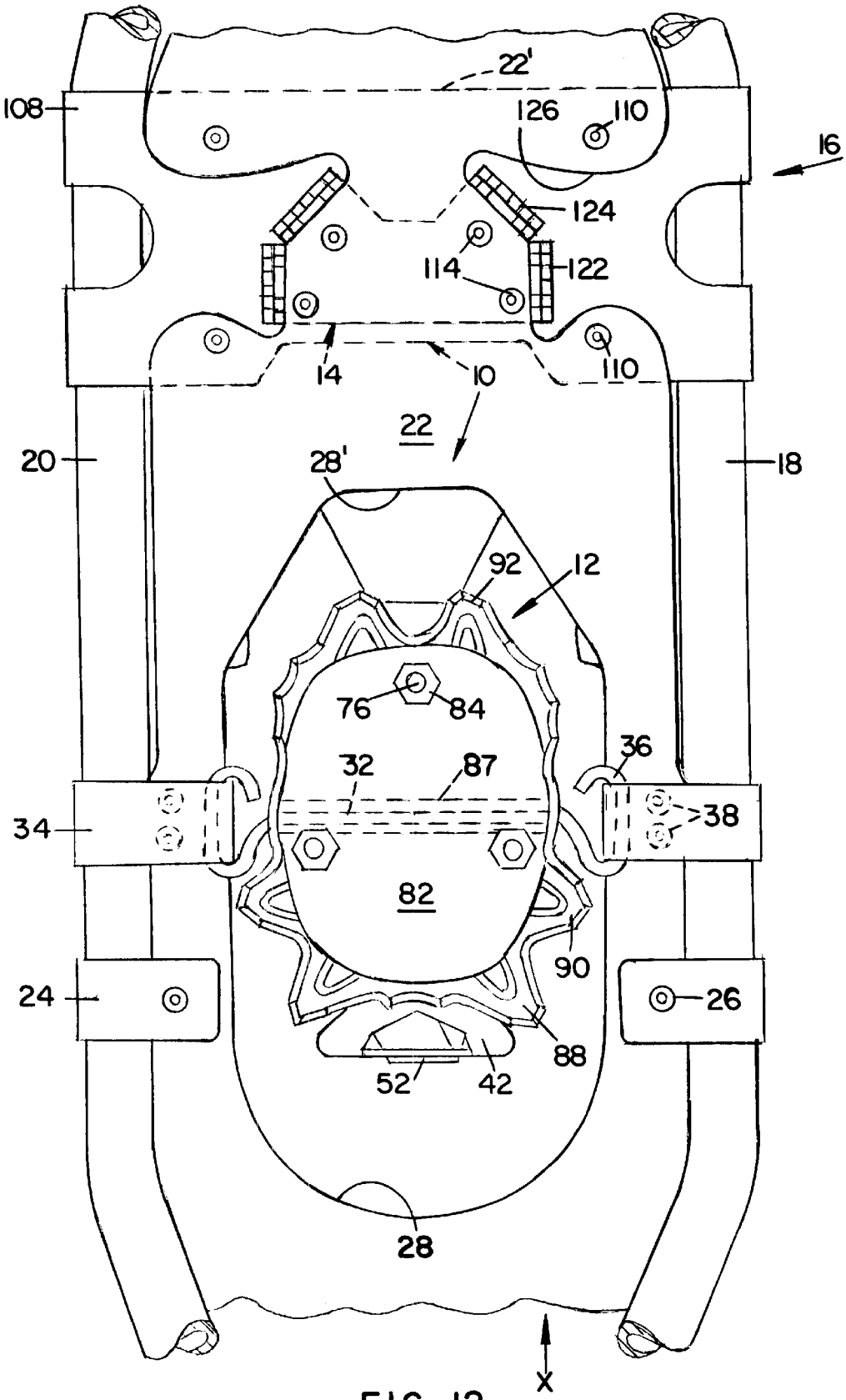
FIG. 12 is a fragmentary, bottom plan view of the snowshoe of FIG. 11.

Snowshoe frame 16 is shown fragmentarily in FIGS. 11 and 12 and Includes a pair of spaced, generally parallel, tubular, side rails 18 and 20 which are joined at their extremities to form curved ends, not shown, at each end of the snowshoe, in known manner.

Decking 22, which is preferably fabricated from any strong, resilient plastic material, is disposed within the interior of frame 16 and Is attached to the frame as by straps 24 formed Integrally with the decking which partially encircle the frame side rails, the straps being fixed in place as by rivets 26 or the like.

An opening 28 is provided in a forward portion of decking 22, looking in the direction of the arrow X in FIG. 11, to permit pivotal movement of a snowshoe binding 30 relative to the decking and frame, the binding being fixed to a pivot axle 32 disposed there-below so as to be positioned below the ball of the foot of a user. Pivot axle 22 extends transversely between and is secured at its opposite ends to side rails 18 and 20 of the frame by a strap 34 which encircles a respective side rail and passes through a loop 36 formed integrally with the pivot axle at opposite ends thereof, each strap being secured in place as by rivets 38.

Snowshoe binding 30 forms a boot support and is molded from a high impact plastic material to form an integral unit comprising: a flat, substantially rectangular base 40 having a plurality of frusto-conical anti-slip pins 41 extending upwardly from its upper face for preventing boot slippage; a toe support 42 extending forwardly and upwardly from its forward end; a pair of spaced, upright instep supports 44 and 46 disposed approximately centrally of its length and extending upwardly from each side face thereof; and a pair of substantially upright spaced control wings 48 and 50 extending rearwardly from its rearward end.

A first strap 52 is fixed at one end to instep support 44, passes though a slot 54 provided in toe support 42, passes through a slot, not shown, provided in the other instep support 46, and back to instep support 44, where it is releasibly clamped in a buckle 58 fixed to that instep support.

As best seen in FIG. 11, first strap 52 assumes a triangular dispensation in plan and extends across the top of the toe and instep of the boot of a user, not shown, for securely holding the boot in place.

A second strap 60 extends between and curvilinearly rearwardly from the rearward ends of control wings 48 and 50 so as to embrace the heel of the boot of a user, not shown.

An inwardly facing, elliptically shaped pad or cushion 62 is positioned centrally of the length of second strap 60 for embracing the heel of the boot of a user, thereby effectively precluding chaffing of the boot heel by the strap.

The outer face of second strap 60 is provided adjacent each free end 64 and 66 thereof with a series of parallel, rearwardly inclined teeth 68 and 70 respectively.

Free end 64 of second strap 60 is slidably receivable through and outwardly from a buckle 72 fixed to the outer face of control wing 48 adjacent the reward end of the latter.

Buckle 72 is preferably of the spring-loaded type, wherein a detent, not shown, is engageable between teeth 68 of the strap for holding free end 64 of the strap in a set position.

Free end 64 of second strap 60 may be slidably moved relative to buckle 72 by the simple expedient of depressing the detent with the fingers whereby the detent is moved out of its position of engagement between teeth 68 to permit free forward or rearward movement of the strap to a desired position of adjustment, at which time pressure of the fingers on the detent is released to allow the detent to return to its position of engagement between teeth 68 to hold free end 64 in a set position.

The opposite free end 66 of second strap 60 extends through and outwardly from a buckle 74 of the compound detent and ratchet type fixed to the outer face of control wing 50 adjacent the rearward end of the control wing, the detent or ratchet thereof being selectively engageable between teeth 70 of the strap for either holding the free end 66 in a set position or permitting sliding movement thereof.

Toe crampon 12 is disposed below and is fixed to base 40 of binding 30 by bolts 76 which pass downwardly through openings in the binding, not shown, which are aligned with openings 78 in a foot plate or top wall 80 of the toe crampon and aligned openings, not shown, in a protective member 82 which bears against the lower face of foot plate 80, as best seen in FIG. 12, with bolts 76 having nuts 84 threaded thereon to firmly secure the crampon to the binding and secure protective member 82 to the crampon.

Protective member 82 is preferably fabricated from any strong, resilient plastic material and forms a barrier which prevents snow from packing the toe crampon.

Approximately centrally of its length, foot plate 80 of toe crampon 12 is provided with a channel or depression 85 which extends transversely across its width.

Channel or depression 85 accommodates pivot axle 32 which may have a bearing 87 sleeved thereon to facilitate rotational movement of the binding relative to the pivot axle and relative to snowshoe frame 16.

Figure 1:
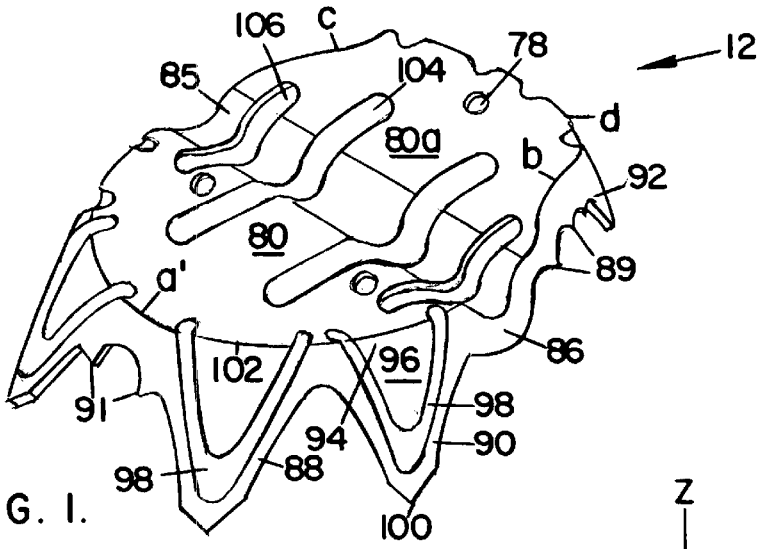
FIG. 1 is a top perspective view of the toe crampon of the invention.
Figure 3A:
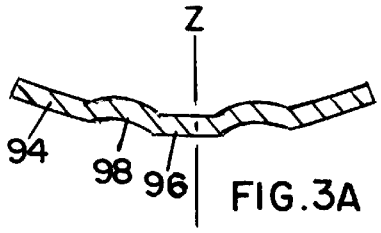
FIG. 3A is a cross sectional view on an enlarged scale taken on line 3A—3A of FIG. 3.
Figure 2:
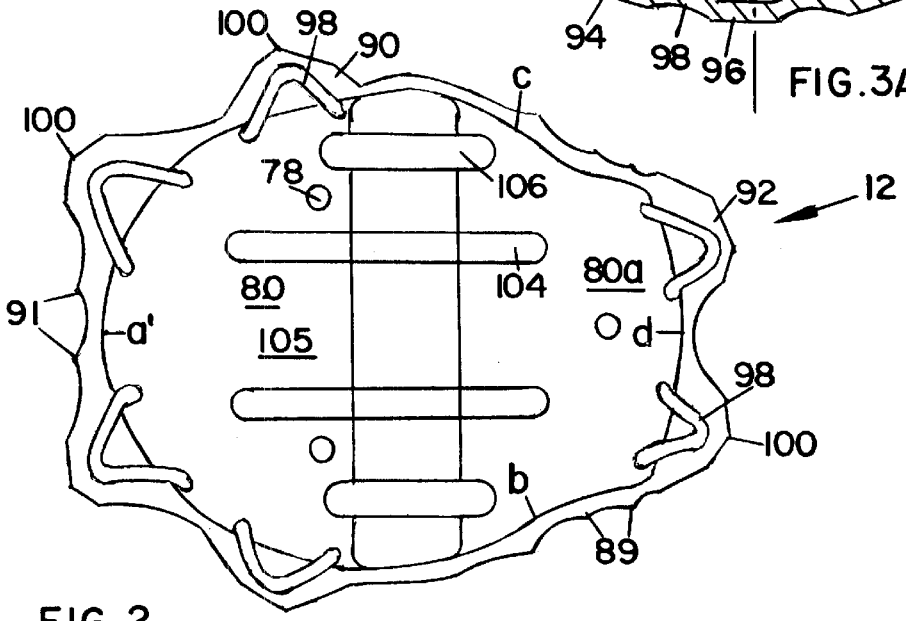
FIG. 2 is a top plan view of the toe crampon of FIG. 1.
Figure 3:
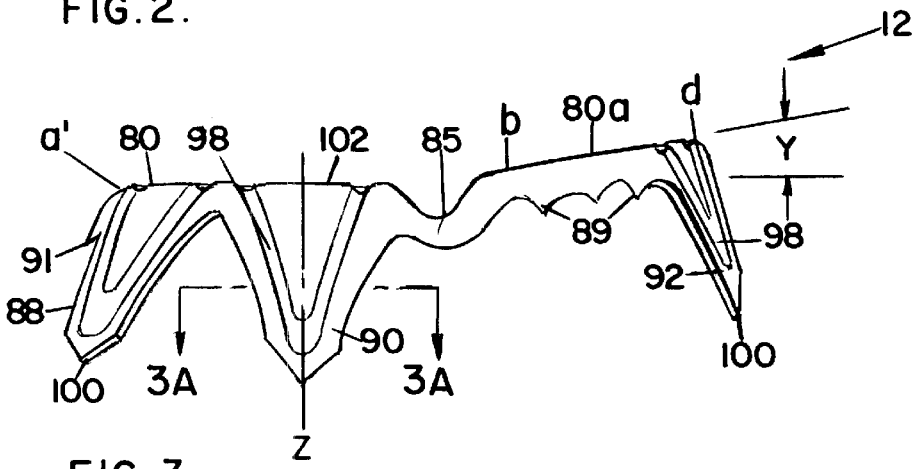
FIG. 3 is a side elevation of the toe crampon as is seen from the right of FIG. 1.
Figure 4:
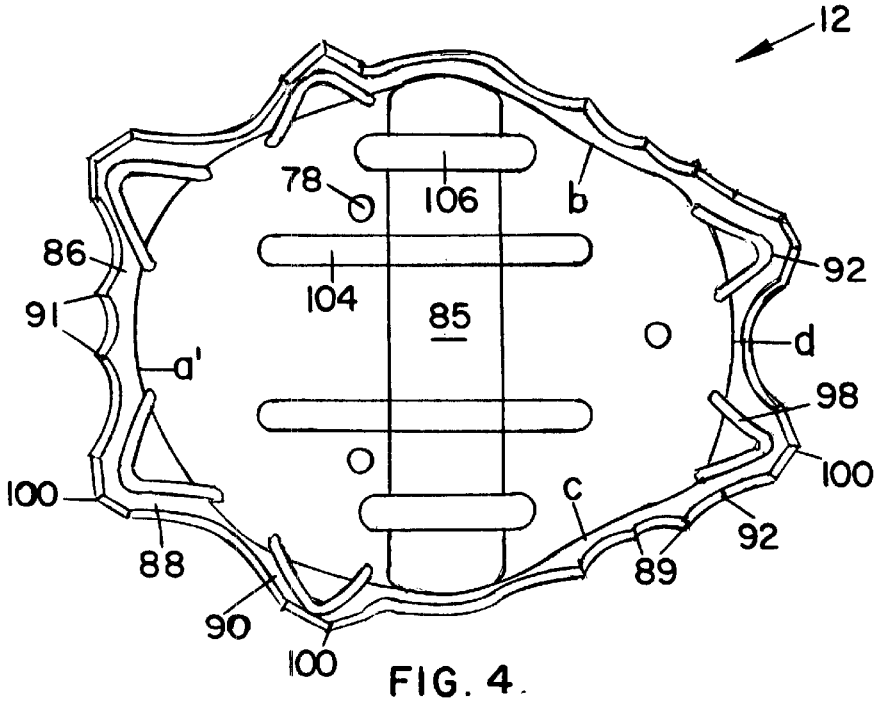
FIG. 4 is a bottom plan view.
Figure 5:
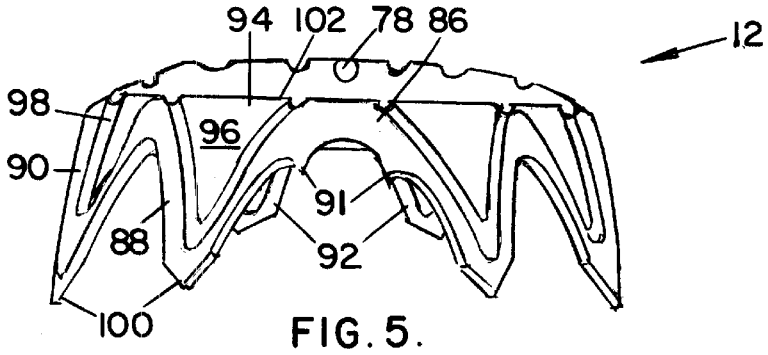
FIG. 5 is a front elevational view.
Figure 6:
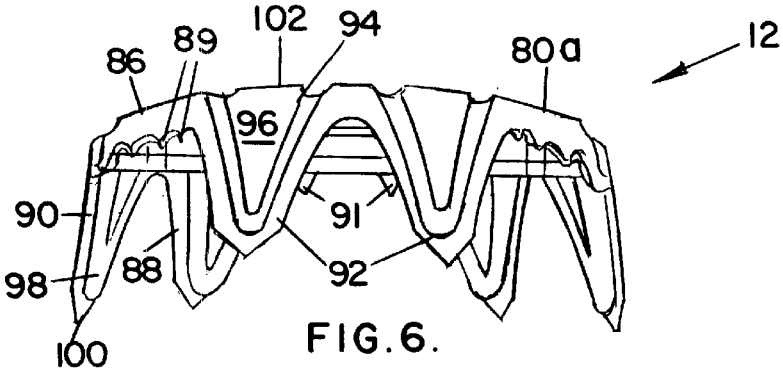
FIG. 6 is a rear elevational view.
Figure 7:
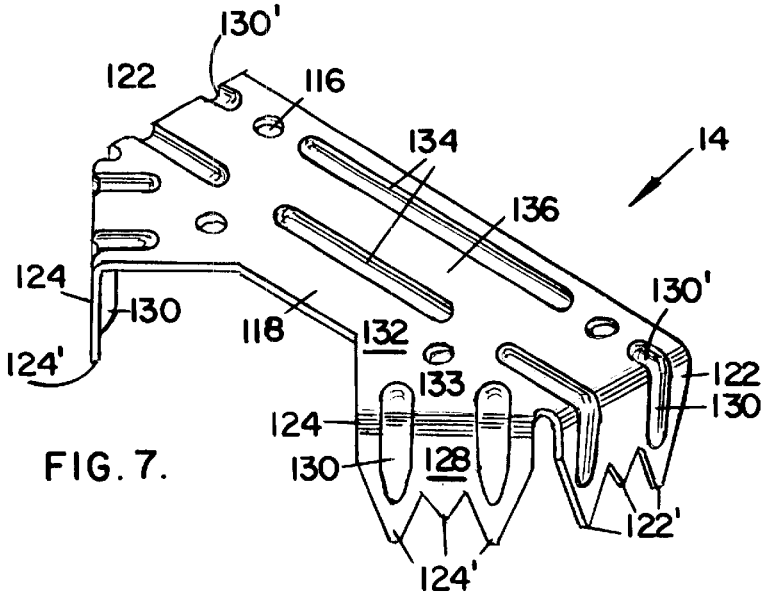
FIG. 7 is a top perspective view of the heel crampon of the invention.
Figure 8:
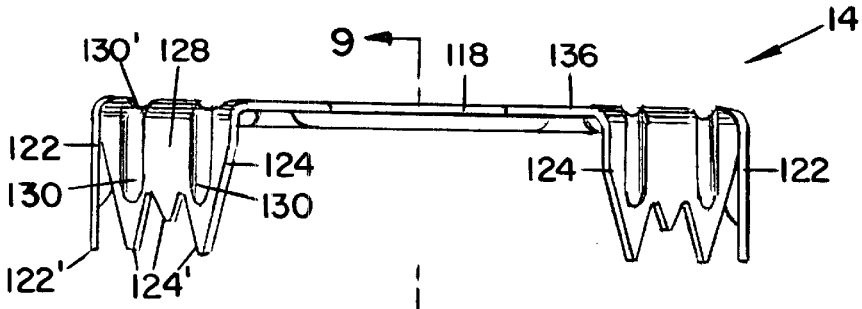
FIG. 8 is a front elevational view of the heel crampon of FIG. 7.
Figure 9:
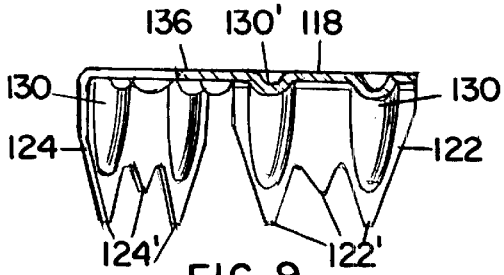
FIG. 9 is a cross sectional view taken on line 9—9 of FIG. 8.
Figure 10:
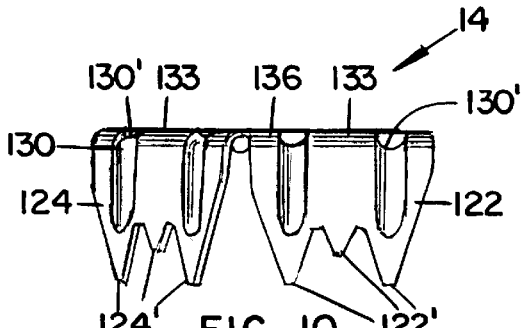
FIG. 10 is a side elevational view of the heel crampon as seen from the right of FIG. 7.

As best seen in FIG. 3, a portion 80*a* of foot plate 80 located rearwardly of channel or depression 85, is angularized so as to be at an approximately 9° angle from a horizontal plane Y to better accommodate binding 30 and the boot of a user.

In top plan, foot plate 80 of toe crampon 12 is somewhat elliptical and presents an entire circumference which is formed on a curved profile, thereby adding tremendous strength and rigidity needed for ice engagement, with little added weight and no linear bend axis.

At its outer edges, foot plate 80 of toe crampon 12 curves angularly downwardly to provide a formed, integral, circumferential skirt 86 which links three pair of teeth, each pair being identified by its primary function, namely: forward climbing teeth 88; lateral traction teeth 90; and rear braking teeth 92, with each tooth extending angularly downwardly and outwardly from foot plate 80.

The lower edge of skirt 86 is provided with a trio of mini-teeth 89 on each side of the foot plate 80 rewardly of channel or depression 85; and the lower edge of skirt 86 is also provided with a pair of mini-teeth 91 between climbing teeth 88 to provide added gripping power to the toe crampon.

It is important to note that each pair of teeth 88, 90 and 92 of toe crampon 12 contributes to traction in the other two functions.

Prior art, competitive crampons, on the other hand, are formed by bending the teeth on a linear axis to a near vertical position. The axis of the bend is, effectively, the intersection of two planes.

Each tooth of each pair, 88, 90 and 92 of toe crampon 12 forms an inverted triangle and has an outwardly-facing surface 94 which is crowned or convexly outwardly curved along its length. As best seen in FIG. 3A, a high point 96 of tooth surface 94 is located on the central longitudinal axis Z of the tooth. When tested, it has been found that such crowning adds 50% more strength to the teeth, without adding weight.

Outer surface 94 of each tooth of each pair, 88, 90 and 92 of toe crampon 12 is also provided along its length with an inverted triangular groove or depression 98 and each tooth comes to an inverted triangular, point 100 at its lower end.

The upper ends of triangular groove or depression 98 extend into foot-plate 80 of toe crampon 12 to effectively provide a gusset 102 for each tooth at the circumferential edge of the foot plate, thereby strengthening each tooth. The crowning of each tooth not only strengthens the tooth, but also provides for better snow and ice penetration.

Climbing teeth 88 depend angularly downwardly and outwardly from a forward edge a' of foot plate 80; lateral traction teeth 90 depend angularly downwardly and outwardly from side edges b and c of the foot plate; and braking teeth 92 depend angularly downwardly and outwardly from a rear edge d of the foot plate.

Lateral teeth 90 are positioned forwardly of channel or depression 85 and pivot axle 32, which is located in channel 85 directly under the ball of the foot of a user; the greater length of lateral teeth 90 allows a rolling action on a packed snow surface and imparts added resistance to side slide. The angularizaion of all of the teeth provides a three-axis traction function.

Lateral teeth 90 dig deeper into the snow as the boot of a user pivots forwardly, which is extremely beneficial in side hill traverse.

Braking teeth 92 enable a confident grip on descents, and assist on uphill climbs. Each of the teeth are positioned and angled to assist traction in all snowshoe terrain conditions.

All of the above-noted features of toe crampon 12 offer a high traction solution at relatively light weight.

Foot plate 80 of toe crampon 12 is provided with a pair of spaced, parallel, longitudinally-extending grooves or depressions 104 which are positioned on either side of the central longitudinal axis of the foot plate to provide a gusset 105 which adds strength to the structure. The foot plate is also cut-away as at 106 to provide a pair of openings or cut-outs for weight reduction purposes.

As best seen in FIGS. 11 and 12, heel crampon 14 is located rearwardly of binding 30 and is sandwiched between decking 22, which is disposed therebelow, and a decking reinforcement member 22', which is disposed thereabove and extends transversely between frame side rails 18 and 20, the reinforcement member having integral straps 108 at each end which encircle a respective side rail and are fixed to the side rails as by rivets 110.

Heel crampon 14 is fixed to a generally rectangular heel plate 112 disposed thereabove on the upper face of reinforcement member 22' as by rivets 114 which pass through provided openings in the heel plate, in reinforcement member 22', in decking 22, all not shown, and through openings 116 aligned therewith in an upper wall 118 of the heel crampon.

Heel plate 112 Is so positioned as to be engageable by the heel of the boot of a user, the heel plate having a plurality of frusto-conical, anti-slip pins 120 extending upwardly from Its upper face for preventing heel slippage.

Heel crampon 14, best seen in FIGS. 7–10, is of single piece fabrication. Upper wall 118 thereof is substantially flat, thin, and generally rectangular in top plan and has a pair of lateral traction teeth 122 and a pair of rear braking teeth 124 depending from each end thereof at a substantially 90° angle relative to the plane of upper wall 118.

As best seen in FIG. 12, decking 22 is cut-away or relieved as at 126 inwardly of frame side rails 18 and 20 to accommodate teeth 122 and 124 of the heel crampon.

The positioning of the heel crampon teeth is vital for improved side hill traverse activity in crystallized snow conditions.

The teeth of toe crampon 12 alone give added resistance to side slide; however, when used with heel crampon 14, a wide traction base is provided to resist turning while the snowshoe remains properly aligned until lifted from the snow.

In heel crampon 14, lateral traction teeth 122 are disposed parallel to the direction of snowshoe travel to prevent lateral slide or yawing of the snowshoe and their lower ends are provided with a trio of staggered apexes 122'.

Rear braking teeth 124 of heel crampon 14 are set at an angle relative to the direction of snowshoe travel to assist in both climbing and braking traction and their lower ends are provided with a trio of staggered apexes 124'.

An outer face 128 of each tooth 122 and 124 of heel crampon 14 is provided with a pair of spaced, paralled, vertically-disposed grooves or depressions 130 which extend for substantially the entire length of the teeth and have upper ends 130' which extend horizontally into an outer or upper face 132 of upper wall 118 of heel crampon.

Outer or upper face 132 is provided with a pair of spaced, parallel, longitudinally extending grooves or depressions 134 which are aligned with tooth groove extensions 130'.

Grooves or depressions 130 and 130' in teeth 122 and 124 provide a gusset 133 for each tooth to effectively strengthen each tooth, while grooves or depressions 134 in upper wall 118 provide a gusset 136 for the upper wall for strengthening purposes.

The stainless steel, or titanium, or tool steel, or the like, from which the heel crampon is fabricated, offers excellent strength and abrasion resistance while being thin enough to pierce packed or crystallized snow.

We claim:

1. In a snowshoe having a binding for supporting and confining the boot of a user, the improvement which comprises a crampon system having a toe crampon and a heel crampon, the toe crampon comprising a foot plate fixed to and underlying the binding and having an integral, continuous, peripheral skirt and a trio of tooth pairs depending therefrom, each tooth pair comprising, a pair of forward climbing teeth, a pair of side lateral teeth, and a pair of rear braking teeth, the heel crampon being disposed rearwardly of the binding and comprising a heel plate positioned under the heel of the boot of a user and having a pair of teeth disposed in close adjacency to each other and depending from each end thereof.

2. In the snowshoe according to claim 1, wherein each pair of teeth depending from the heel plate of the heel crampon comprise a lateral traction tooth disposed on a plane parallel to the direction of snowshoe travel, and a rear braking tooth disposed at an angle relative to the direction of snowshoe travel.

3. A snowshoe crampon comprising a foot plate which has a formed, integral, continuous peripheral skirt and a circumferential, curved profile in plan and has pairs of teeth extending angularly downwardly and outwardly therefrom.

4. In the snowshoe crampon according to claim 3, wherein the tooth pairs comprise a pair of climbing teeth which extend angularly downwardly and forwardly from the foot plate and are disposed forwardly of the toe of the boot of a user, a pair of spaced lateral traction teeth, each of which extend laterally angularly downwardly and outwardly from a side of the foot plate, and a pair of braking teeth which extend angularly downwardly and rearwardly from the foot plate.

5. In the snowshoe crampon of claim 3, wherein a portion of the foot plate is disposed at an angle from a horizontal plane.

6. A snowshoe crampon comprising a foot plate which has a formed skirt and a circumferential, curved profile in plan and has pairs of teeth extending angularly downwardly and outwardly therefrom, each tooth being of inverted, triangular shape in elevation and having an outwardly curved, convex, crowned outer face, said outer face having an inwardly-extending groove of inverted, triangular shape therein, said groove forming a gusset with the foot plate for strengthening the tooth.

7. In the snowshoe crampon according to claim 6, wherein each tooth has a lower extremity of inverted, triangular shape.

* * * * *